US006457813B2

(12) United States Patent
Silverbrook

(10) Patent No.: US 6,457,813 B2
(45) Date of Patent: Oct. 1, 2002

(54) NOZZLE ARRANGEMENT FOR AN INK JET PRINTHEAD HAVING AN ACTUATOR MECHANISM THAT INCORPORATES SPRING MOVEMENT

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/864,334

(22) Filed: May 25, 2001

Related U.S. Application Data

(63) Continuation-in-part of application No. 09/113,097, filed on Jul. 10, 1998, now Pat. No. 6,247,795.

(30) Foreign Application Priority Data

Jul. 15, 1997 (AU) ..... PO8047

(51) Int. Cl.[7] ..... B41J 2/06; B41J 2/04
(52) U.S. Cl. ..... 347/54; 347/44
(58) Field of Search ..... 347/20, 44, 53, 347/54, 85, 84, 47, 68

(56) References Cited

U.S. PATENT DOCUMENTS 4,415,910 A * 11/1983 Reece ..... 347/54
5,602,575 A * 2/1997 Pauly ..... 347/54
5,907,339 A 5/1999 Evans et al.
6,244,691 B1 * 6/2001 Silverbrook ..... 347/54
6,257,705 B1 * 7/2001 Silverbrook ..... 347/54

FOREIGN PATENT DOCUMENTS

JP 354151447 A * 11/1979 ..... B41J/003/04
JP 401229638 A * 9/1989 ..... B41J/003/04
JP 402127046 A * 5/1990 ..... B41J/002/015

* cited by examiner

*Primary Examiner*—John Barlow
*Assistant Examiner*—Julian D. Huffman

(57) ABSTRACT

A nozzle arrangement for an ink jet printhead includes a substrate. A micro electro-mechanical actuator mechanism is arranged on the substrate. A prime mover is provided that is displaceable between a released position and a loaded position with respect to the substrate. Spring devices are connected between the prime mover and the substrate and are configured so that, when the prime mover is displaced into the loaded position, the spring devices are tensioned. A loading mechanism is operatively arranged with respect to the prime mover to act on the prime mover so that the prime mover is displaced into the loaded position. The loading mechanism is connectable to a control system so that the loading mechanism can be de-activated when required to release the prime mover allowing the prime mover to be displaced under action of the spring devices.

7 Claims, 5 Drawing Sheets

NOZZLE ARRANGEMENT FOR AN INK JET PRINTHEAD HAVING AN ACTUATOR MECHANISM THAT INCORPORATES SPRING MOVEMENT

RELATED AND CROSS REFERENCED PATENT APPLICATIONS

This application is a continuation-in-part application of U.S. patent application Ser. No. 09/113,097, filed Jul. 10, 1998, now U.S. Pat. No. 6,247,795. U.S. Pat. Nos. 6,247,795 and 6,257,705 are hereby incorporated by reference.

FIELD OF THE INVENTION

This invention relates to a nozzle arrangement for an ink jet printhead. In particular, this invention relates to a nozzle arrangement that incorporates a spring movement in a working stroke.

BACKGROUND OF THE INVENTION

The Applicant has invented a printhead chip which is capable of printing text and images at a resolution of up to 1600 dpi. While developing this technology, the Applicant has filed many patent applications covering various inventions which have been conceived during this development.

A large proportion of the inventions are in the field of micro electro-mechanical systems. These systems allow up to 84000 nozzle arrangements to be formed on a single printhead chip. As a result of various constraints arising from the necessity for the high density of nozzle arrangements, it has been necessary to design the systems in such a way that each nozzle arrangement, in most cases, includes one or more moving parts which serve to eject the ink from each of the nozzle chambers defined by the nozzle arrangements.

As a result of the extent of work carried out in this area, the applicant has identified that it would be advantageous to provide a means whereby movement of an actuator in such nozzle arrangements remained consistent and was not dependent upon the application of a possibly variable force to the actuator.

FIG. 1 of the drawings shows a prior art example of an actuator mechanisms 10 which uses piezo-electric movement to achieve the ejection of ink from an ink ejection port 12. Applicant has identified a disadvantage with such an arrangement in that the extent of movement of a piezo-electric element 14 is dependent upon strength of a piezo-electric signal. Accordingly, Applicant has found that it can be difficult to achieve consistent movement of the element 14.

This invention is directed to providing a means whereby consistent actuating movement of a prime mover in a nozzle arrangement can be achieved.

SUMMARY OF THE INVENTION

According to the invention, there is provided a nozzle arrangement for an ink jet printhead, the nozzle arrangement comprising

- a substrate; and
- a micro electro-mechanical actuator mechanism arranged on the substrate and comprising
  - a prime mover that is displaceable between a released position and a loaded position, with respect to the substrate;
  - at least one spring device connected between the prime mover and the substrate and configured so that, when the prime mover is displaced into the loaded position, the, or each, spring device is tensioned; and
  - a loading mechanism that is operatively arranged with respect to the prime mover to act on the prime mover so that the prime mover is displaced into the loaded position, the loading mechanism being connectable to a control system so that the loading mechanism can be de-activated when required to release the prime mover allowing the prime mover to be displaced under action of the, or each, spring device.

The invention is now described, by way of example only, with reference to the accompanying drawings. It is to be understood that the specific nature of the following description is not to be construed as limiting the scope of the above summary.

DETAILED DESCRIPTION OF THE DRAWINGS

Figure 1:
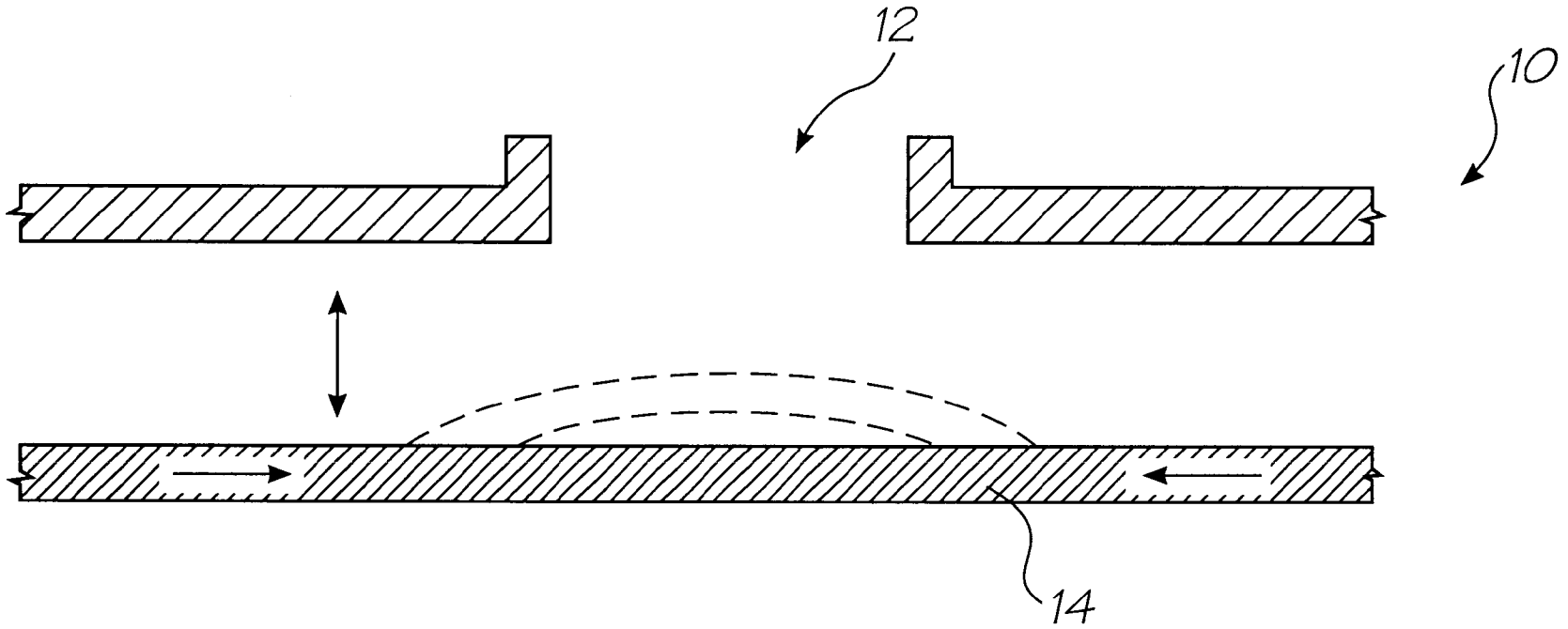
FIG. 1 shows a prior art nozzle arrangement that incorporates a piezo-electric actuating mechanism.

The nozzle arrangement of FIG. 1 is described above under the heading "Background of the Invention".

In FIGS. 2 to 5, reference numeral 20 generally indicates a first embodiment of a nozzle arrangement, in accordance with the invention.

The nozzle arrangement 20 includes a substrate in the form of side walls 22, a floor 24 and a roof 26. The walls 22, the floor 24 and the roof 26 define a nozzle chamber 28. The roof 26 defines a fluid ejection port 30 so that fluid 32 in the nozzle chamber 28 can be ejected from the port 30.

The nozzle arrangement 20 includes a prime mover in the form of a magnetic paddle 34 that is positioned in the nozzle chamber 28. A pair of opposed spring devices or springs 36 are connected between opposed ends of the magnetic paddle 34 and respective side walls 22.

Figure 2:
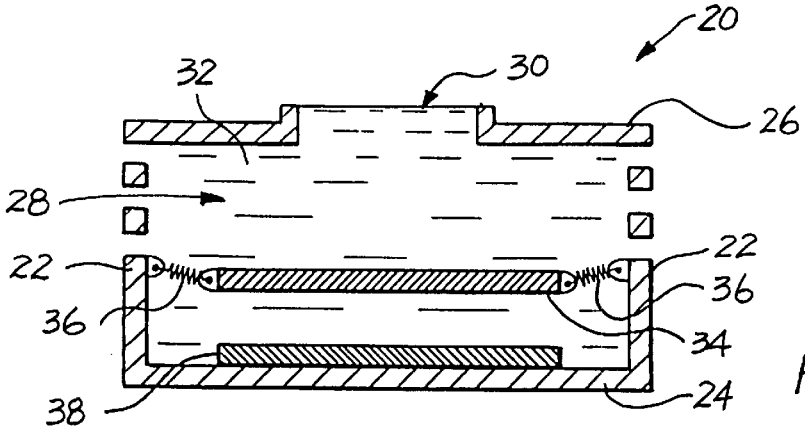
FIG. 2 shows a schematic side sectioned view of a first embodiment of a nozzle arrangement, in accordance with the invention, with a prime mover in a quiescent, released position.
Figure 3:
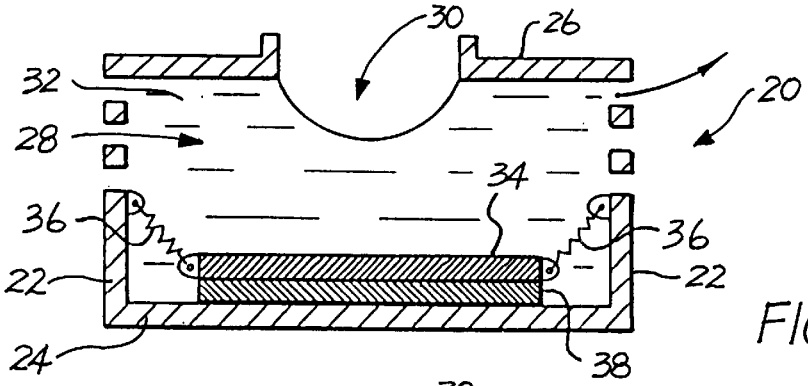
FIG. 3 shows the nozzle arrangement of FIG. 2 with the prime mover in an initial loaded position.
Figure 4:
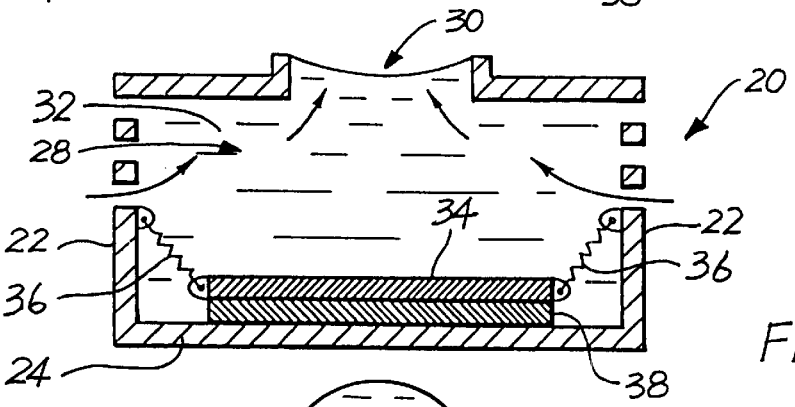
FIG. 4 shows the nozzle arrangement of FIG. 2 with the prime mover in a further loaded position.
Figure 5:
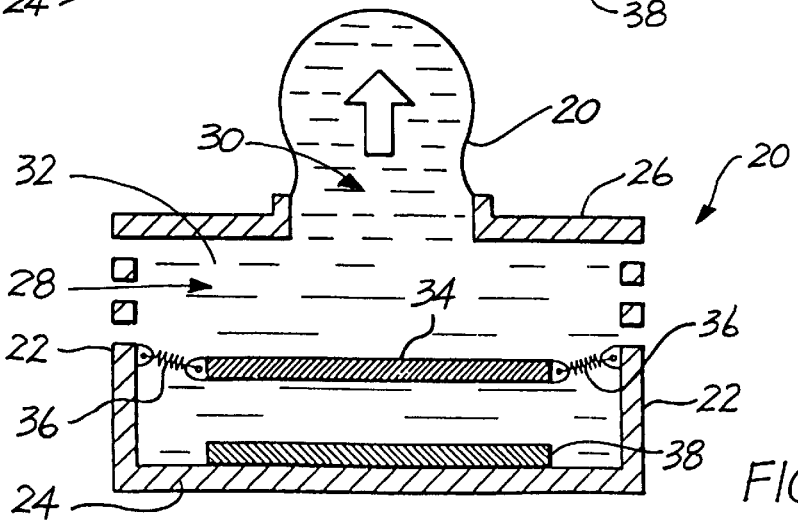
FIG. 5 shows the nozzle arrangement of FIG. 2 with the prime mover in a released, active position, ejecting fluid from the nozzle arrangement.

The magnetic paddle 34 is displaceable, from a released position as shown in FIGS. 2 and 5; to a loaded position, under tension of the springs 36, as shown in FIGS. 3 and 4.

The springs 36 are configured so that, when the magnetic paddle 34 moves under tension of the springs 36 from the loaded position to the released position, the fluid 32 can be ejected from the nozzle chamber 28 out through the ejection port 30.

The nozzle arrangement 20 includes a loading mechanism in the form of an electromagnet 38 positioned on a floor 24 of the nozzle chamber 28. The electromagnet 38 is connected to electrical drive circuitry (not shown) so that the electromagnet 38 can be activated, when required. The electromagnet 38 and the magnetic paddle 34 are configured so that, when the electromagnet 38 is activated, the magnetic paddle 34 is drawn from the released position into the loaded position.

Each of the walls 22 have fluid inlets 40 defined therein. The fluid inlets 40 are positioned between the ejection port 30 and the magnetic paddle 34, when the magnetic paddle 34 is in the released position. Thus, when the magnetic paddle 34 moves towards the electromagnet 38, fluid is drawn into the nozzle chamber 28.

Figure 6:
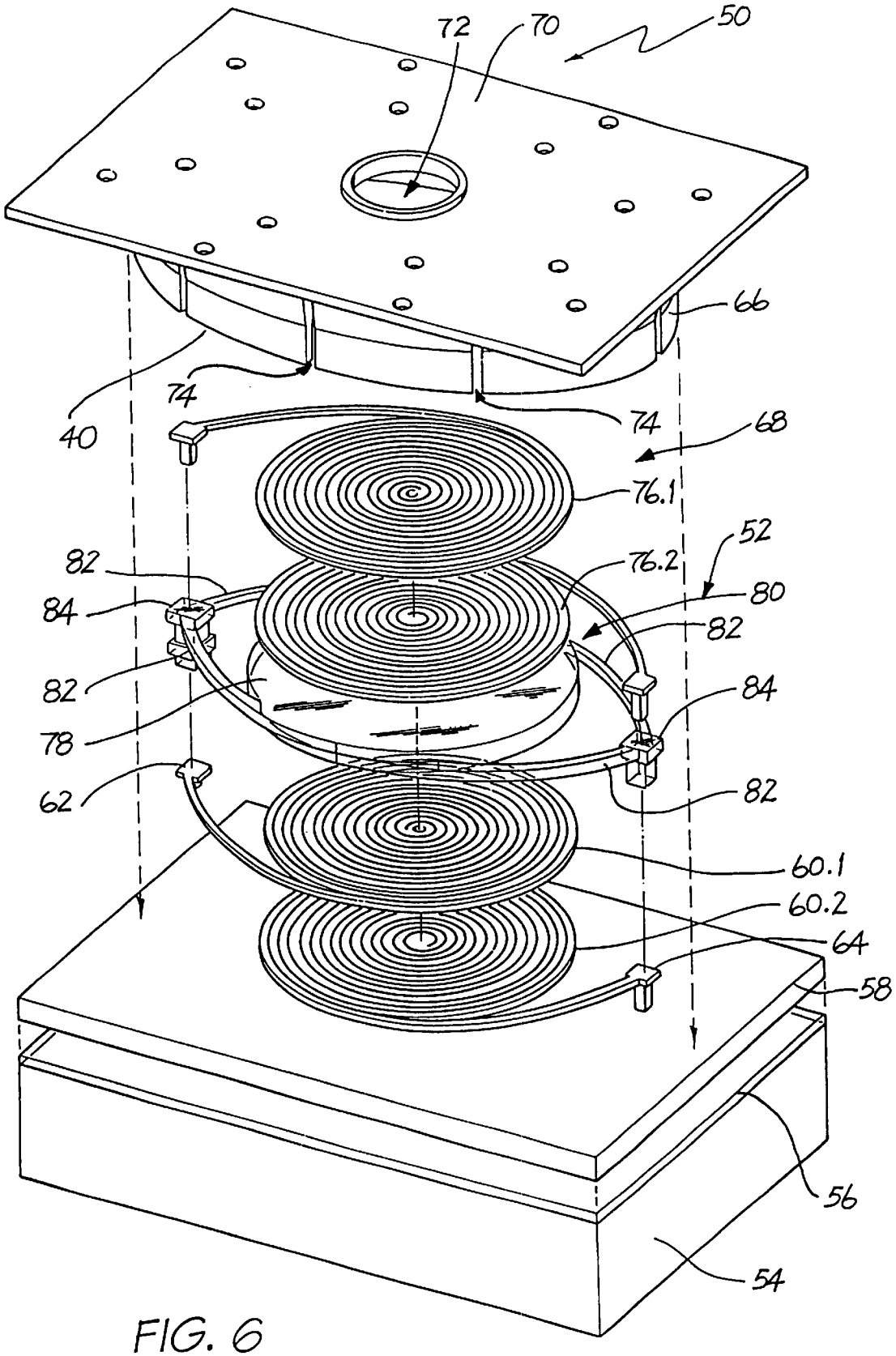
FIG. 6 shows an exploded view of a second embodiment of a nozzle arrangement, in accordance with the invention.
Figure 7:
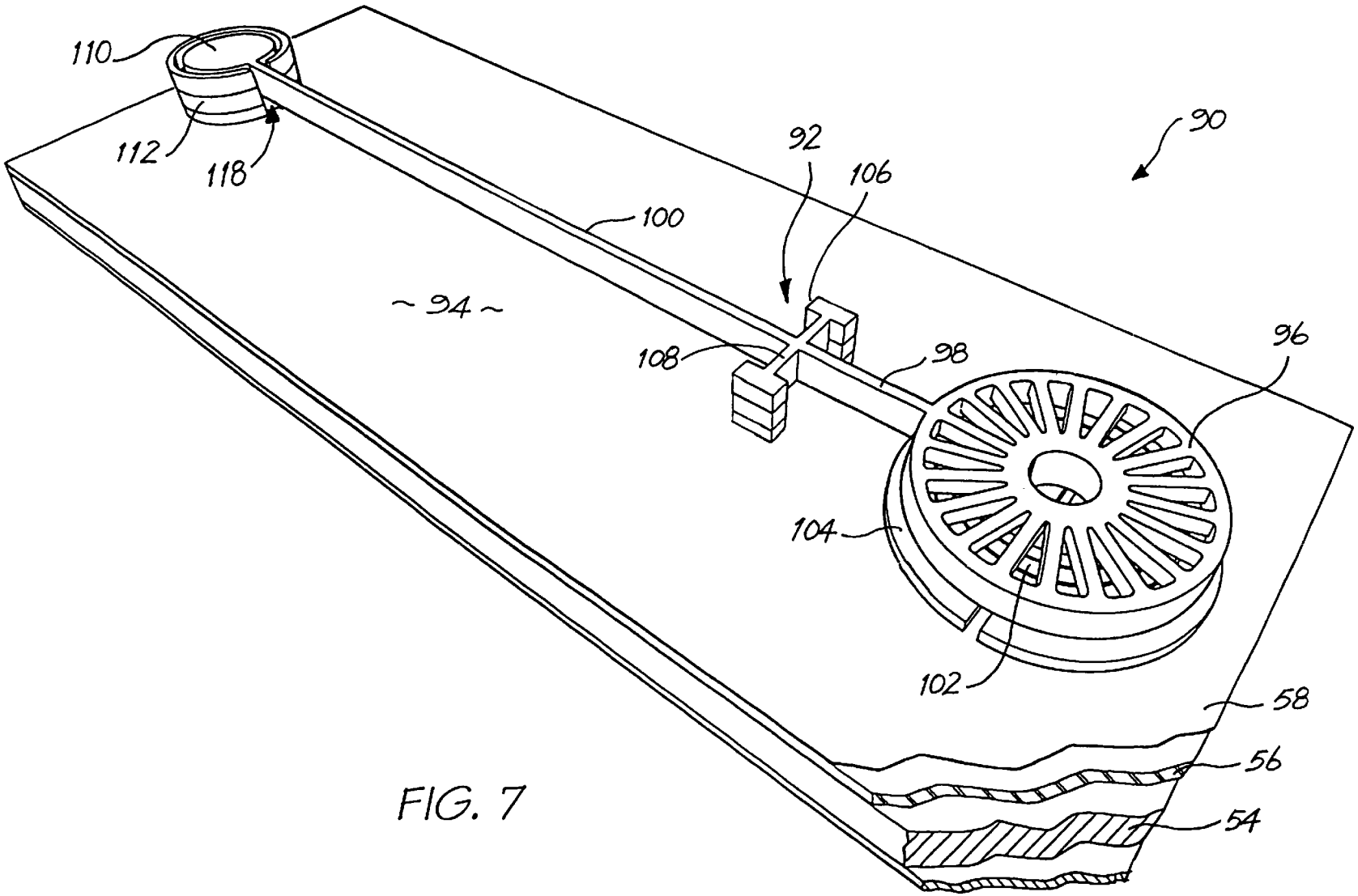
FIG. 7 shows a three dimensional view of a third embodiment of a nozzle arrangement, in accordance with the invention.

The nozzle arrangement 20 is described above as a simple illustration of the principle of operation of an actuator mechanism, in accordance with the invention. In FIGS. 6 and 7, further detailed examples of the mechanism are provided. It should be borne in mind however, that the invention will find application in many different configurations of nozzle arrangements which define micro electromechanical systems.

In FIG. 6, reference numeral 50 generally indicates an exploded view of a second embodiment of a nozzle arrangement, in accordance with the invention, which incorporates a micro electromechanical actuator mechanism 52. With reference to FIGS. 1 to 5, like reference numerals refer to like parts, unless otherwise specified.

The nozzle arrangement 50 is one of a plurality of such nozzle arrangements formed on a wafer substrate 54 to define a printhead chip. An electrical drive circuitry layer 56 is positioned on the wafer substrate 54. A silicon nitride layer 58 is positioned on the drive circuitry layer 56.

An electrical coil 60, formed in two parts 60.1 and 60.2 is formed in the silicon nitride layer 58 and is electrically connected to the drive circuitry layer 56 at 62 and 64.

An arcuate wall 66 of a suitable integrated circuit fabrication material is formed on the layer 58 to define a nozzle chamber 68. A roof wall 70 is formed on the arcuate wall 60 and defines an ink ejection port 72. The arcuate wall 66 has a plurality of slots 74 defined therein to permit the ingress of ink into the nozzle chamber 68.

A prime mover in the form of a further coil 76 formed in two parts 76.1 and 76.2 embedded in silicon nitride 78 is mounted in the nozzle chamber 68 to define a moving paddle 80. The silicone nitride 78 further defines a pair of torsional springs 82 on each side of the paddle 80. The silicon nitride 78 defines a pair of opposed vias 84 which extend from the silicon nitride layer 58 so that the paddle 80 is suspended above the coil 60. Ends of the parts 76.1, 76.2 are connected to the drive circuitry layer 67 at the vias 84 at 62 and 64 so that electrical signals can be received by the coils 60 and 76 simultaneously.

The coils 60, 76 are wound so that, when an electrical signal from the drive circuitry layer 56 is received by the coils 60, 76, the paddle 80 is attracted to the layer 58 and moves into a loaded position. When the electrical signal is terminated, the paddle 80 moves into a released position under action of the torsional springs 82. This results in the ejection of ink from the ink ejection port 72. It will be appreciated that, when the paddle 80 moves into the loaded position, the resultant reduction of ink pressure within the nozzle chamber 68 results in the inflow of ink into the nozzle chamber 68 via the slots 74.

Cross referenced U.S. application Ser. No. 09/113,007 sets out further detail of the nozzle arrangement 50 and detail concerning the manner in which the nozzle arrangement 50 is manufactured. It follows that this detail will not be set out in this specification.

Figure 8:
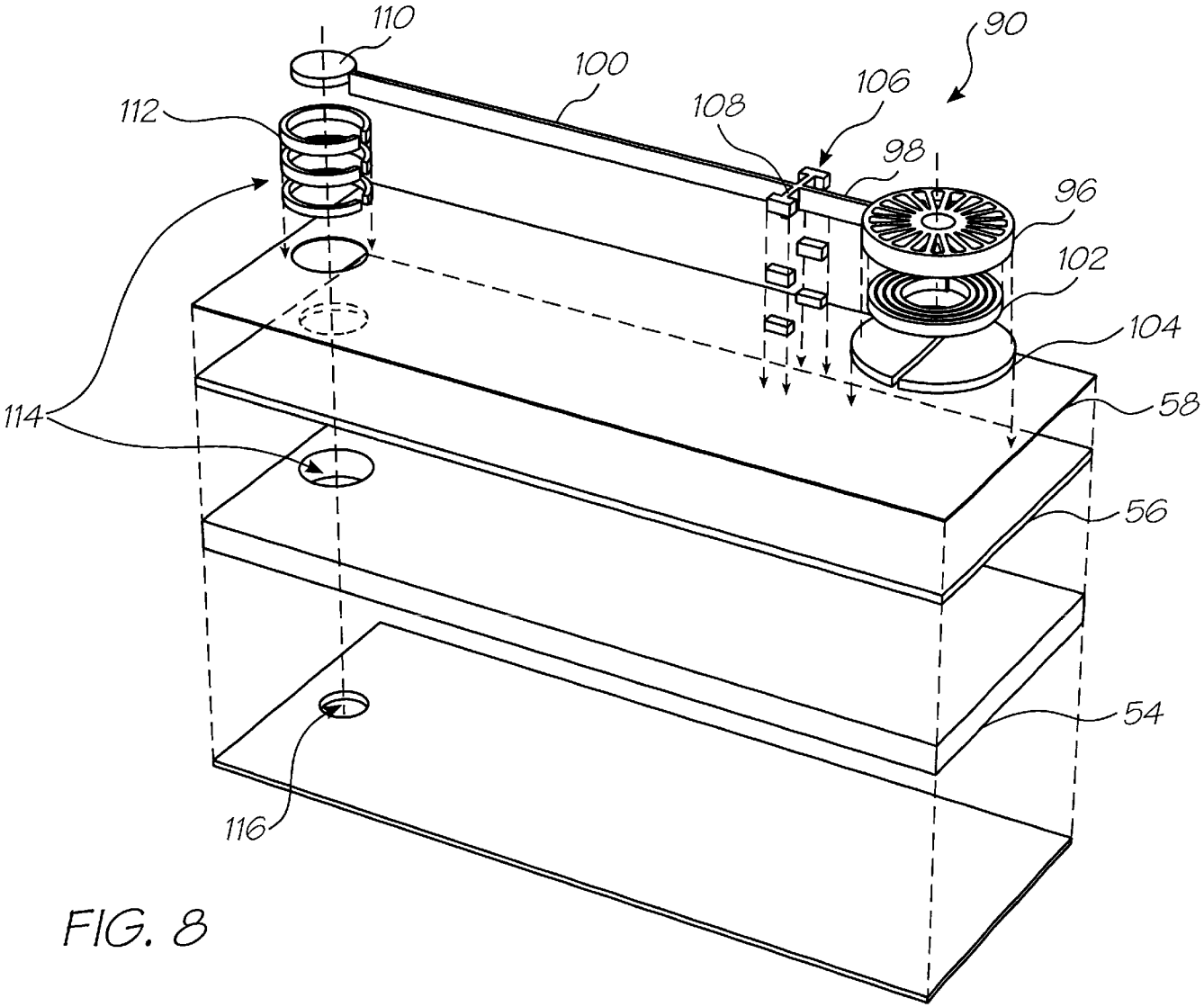
FIG. 8 shows an exploded view of the nozzle arrangement of FIG. 7.

In FIGS. 7 and 8, reference numeral 90 generally indicates a third embodiment of a nozzle arrangement which incorporates an actuator mechanism. With reference to FIG. 6, like reference numerals refer to like parts, unless otherwise specified.

The nozzle arrangement 90 incorporates a class one lever mechanism 92 arranged on a back-surface 94 of the wafer substrate 54.

The class one lever mechanism 92 includes an effort arm 98 and a load arm 100. A permanent magnet 96 is mounted on an end of the effort arm 98. An electrical coil 102 is formed in a silicon nitride member 104 and positioned on the back surface 94 of the substrate 54 between the permanent magnet 96 and the back surface 94.

The class one lever mechanism 92 includes a fulcrum 106 which is also mounted on the back surface 94. The fulcrum 106 incorporates a bridge member 108 which is fast with both the effort arm 98 and the load arm 100. The bridge member 108 is of a suitably torsionally resilient material and is configured so that, when the coil 102 is not activated, the arms 98, 100 are positioned at rest with the permanent magnet 96 spaced a predetermined distance from the silicon nitride member 104. Upon actuation of the electrical coil 102, the permanent magnet 96 and the coil 102 are configured so that the permanent magnet 96 is displaced towards the electrical coil 102. A plunger 110 is mounted on an end of the load arm 100. A nozzle chamber wall 112 extends backwardly from the surface 94 and defines part of a nozzle chamber 114 which extends through the substrate 54 to be in fluid communication with an ink ejection port 116. The nozzle chamber wall 112 defines a slot 118 through which the load arm 100 extends with the plunger 110 corresponding generally to a cross sectional dimension of the nozzle chamber 114.

The load arm 100 is significantly longer than the effort arm 98. Thus, a relatively short movement of the permanent magnet 96 towards the silicon nitride member 104 results in sufficient movement of the plunger 110 to draw ink into the nozzle chamber 114. When the electrical coil 102 is deactivated, the plunger 110 moves, under the release of tension of the bridge member 108 to eject ink from the ink ejection port 116.

Details of the structure and method of manufacture of the nozzle arrangement 90 are provided in the cross referenced application Ser. No. 09/113,097 and are therefore not set out in this specification.

In all examples in accordance with this invention, the working movement of the actuator mechanism is carried out through the uncoiling or unwinding of a spring device. This has significant advantages with nozzle arrangements for ink jet printheads where consistency of work movement is highly desirable. Such a provision of working movement through the release of a spring device can allow. a plurality of nozzle arrangements incorporating actuator mechanisms of this invention to be compatible with force/time requirements of drop ejection. In particular, a spring can be selected to be consistently compatible with various inks used in such arrangements.

I claim:

1. A nozzle arrangement for an ink jet printhead, the nozzle arrangement comprising a substrate that defines a nozzle chamber in which ink is receivable; and a micro electro-mechanical actuator arranged on the substrate and comprising a prime mover that is displaceable between a released position and a loaded position, with respect to the substrate, the prime mover being positioned with respect to the nozzle chamber so that the prime mover can act on the ink received in the nozzle chamber to eject ink from the nozzle chamber when the prime mover moves between the released and loaded positions;

at least one spring device connected operatively between the prime mover and the substrate and configured so that, when the prime mover is displaced into the loaded position, the at least one spring device is tensioned; and a loading mechanism that is operatively arranged with respect to the prime mover to act on the prime mover so that the prime mover is displaced into the loaded position, the loading mechanism being connectable to a control system so that the loading mechanism can be de-activated when required to release the prime mover allowing the prime mover to be displaced under action of the at least one spring device into the released position.

2. A nozzle arrangement as claimed in claim 1, in which the substrate incorporates a silicon wafer substrate.

3. A nozzle arrangement as claimed in claim 1, in which the prime mover is displaceable on the application of a magnetic field on the prune mover, the loading mechanism being in the form of a magnetic field generator which is configured to generate a magnetic field of sufficient strength to displace the prime mover from the leased position into the loaded position.

4. A nozzle arrangement as claimed in claim 3, in which at least a portion of the prime mover is of a magnetic material having magnetic properties which are suitable for the displacement of the prime mover against the at least one spring device upon activation of the loading mechanism.

5. A nozzle arrangement as claimed in claim 4, in which the magnetic field generator is in the form of at least one electrical coil that is configured to generate said magnetic field of sufficient strength.

6. A nozzle arrangement as claimed in claim 4, in which the prime mover incorporates an electrical coil that is complementary to the electrical coil of the magnetic field generator, the electrical coils being connectable to the control system so that they can be energized in a synchronous manner.

7. An ink jet printhead which includes a plurality of nozzle arrangements as claimed in claim 1.

* * * * *

UNITED STATES PATENT AND TRADEMARK OFFICE

CERTIFICATE OF CORRECTION

PATENT NO. : 6,457,813 B2
DATED : October 1, 2002
INVENTOR(S) : Kia Silverbrook

It is certified that error appears in the above-identified patent and that said Letters Patent is hereby corrected as shown below:

Column 5, lines 24 and 25 to Column 6, lines 1-5,
Should read:

3. A nozzle arrangement as claimed in claim 1, in which the prime mover is displaceable on the application of a magnetic field on the prime mover, the loading mechanism being in the form of a magnetic field generator which is configured to generate a magnetic field of sufficient strength to displace the prime mover from the released position into the loaded position.

Signed and Sealed this

Seventh Day of January, 2003

JAMES E. ROGAN
*Director of the United States Patent and Trademark Office*